US007483665B2

(12) United States Patent
Fujiwara et al.

(10) Patent No.: US 7,483,665 B2
(45) Date of Patent: Jan. 27, 2009

(54) FIXING DEVICE

(75) Inventors: Daisuke Fujiwara, Osaka (JP); Masashi Fujimoto, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 465 days.

(21) Appl. No.: 11/410,211

(22) Filed: Apr. 25, 2006

(65) Prior Publication Data

US 2006/0245799 A1 Nov. 2, 2006

(30) Foreign Application Priority Data

Apr. 28, 2005 (JP) ..... 2005-132112

(51) Int. Cl.
*G03G 15/20* (2006.01)

(52) U.S. Cl. ..... 399/329; 399/122; 399/331

(58) Field of Classification Search ..... 399/329, 399/122, 331
See application file for complete search history.

(56) References Cited

U.S. PATENT DOCUMENTS 7,194,233 B2 * 3/2007 Wu et al. ..... 399/329
2007/0019979 A1 * 1/2007 Fujii et al. ..... 399/329
2007/0025783 A1 * 2/2007 Jang et al.
2007/0217838 A1 * 9/2007 Yamana et al.

FOREIGN PATENT DOCUMENTS

JP 2003043848 A * 2/2003
JP 2004-212844 7/2004

* cited by examiner

*Primary Examiner*—David M Gray
*Assistant Examiner*—Laura K Roth
(74) *Attorney, Agent, or Firm*—Smith, Gambrell & Russell, LLP

(57) ABSTRACT

A fixing device comprising a fixing roller, support rollers wrapped with a belt, bearings of the support rollers arranged at both ends thereof, pressing plates arranged between the bearings and each having a pair of tilted pressing surfaces that come in contact with the outer circumferential surfaces thereof, and pressing means for pressing the pressing plates toward the axis of the fixing roller. When pressed by the pressing means, the pressing plates press the support rollers toward the axis of the fixing roller via the tilted pressing surfaces and the outer circuferential surfaces of the bearings so that part of the region of the belt in the circumferential direction is press-contacted to part of the region on the outer circuferential surface of the fixing roller and, further, press the support rollers in a direction in which they separate away from each other to impart a tension to the belt.

5 Claims, 6 Drawing Sheets

FIXING DEVICE

BACKGROUND OF THE INVENTION

1. Field of the Invention

The present invention relates to a fixing device mounted on image-forming machines of the type of electrostatic photography, such as a copier, a printer, a facsimile and the like machine. More specifically, the invention relates to a fixing device comprising a fixing roller and two support rollers arranged maintaining a distance in a tangential direction of the fixing roller and wrapped with an endless belt, the support rollers being press-contacted to the fixing roller via the belt.

2. Description of the Related Art

A fixing device mounted on an image-forming machine requires a high temperature and a pressure applied for a predetermined period of time for fixing the unfixed toner onto a paper. In particular, a color image-forming machine, that is becoming ever popular in recent years, requires an increased amount of heat and an elevated pressure as compared to the monochromatic machines to print toners of a multiplicity of colors in an overlapped manner. To meet such a demand, it is advantageous to use a fixing device of the above-mentioned belt type having a large nipping width. A representative example of the above fixing device may be the one comprising a fixing roller (heat roller)and two support rollers wrapped with an endless belt and are press-contacted to the fixing roller via the belt (JP-A-2004-212844).

In the above fixing device, the one support roller is a pressing roller and the other support roller is a tension roller. The pressing roller is supported by a pressing roller support member capable of rotating about a shaft. The pressing roller support member is imparted with a rotational moment in one direction from a tension coil spring so as to rotate about the shaft, and the pressing roller is press-contacted to the fixing roller via the belt. The tension roller is supported by a tension roller support member that is supported by the pressing roller support member via a shaft so as to rotate. The tension roller support member is imparted with a rotational moment in one direction from a compression coil spring so as to rotate about the shaft, and the tension roller is press-contacted to the fixing roller via the belt.

In the above fixing device, a tension is imparted to the belt by a pressing mechanism which includes the tension coil spring and by a pressing mechanism which includes the compression coil spring. Further, the pressing roller and the tension roller are press-contacted to the fixing roller via the belt. Therefore, the entire constitution becomes complex. Besides, it is not easy to set a distribution (ratio) of the tension of the belt and the force of bringing the pressing roller and the tension roller into contact with the fixing roller via the belt.

SUMMARY OF THE INVENTION

It is an object of the present invention to provide a novel fixing device which makes it easy to set a distribution of the tension of the belt and the force of bringing the two support rollers into pressed-contact with the fixing roller via the belt.

According to the present invention, there is provided a fixing device comprising a fixing roller, and two support rollers arranged maintaining a distance in a tangential direction of the fixing roller and wrapped with an endless belt, the support rollers being press-contacted to the fixing roller via the belt, the fixing device further comprising:

support members arranged at both ends of the shafts of the support rollers and having circular outer circumferential surfaces;

pressing members arranged between the support members at both ends thereof and each having a pair of tilted pressing surfaces that come in contact with the outer circumferential surfaces; and pressing means arranged for the pressing members and releasably presses the pressing members toward the axis of the fixing roller;

wherein when pressed by the corresponding pressing means, the pressing members press the support rollers toward the axis of the fixing roller via the pairs of tilted pressing surfaces and via the outer circumferential surfaces of the support members so that part of the region of the belt in the circumferential direction is press-contacted to part of the region on the outer circumferential surface of the fixing roller and, further, press the support rollers in a direction in which they separate away from each other to impart a tension to the belt.

It is desired that both ends of the shaft of the fixing roller are supported by a pair of side plates via bearings so as to rotate, the support members are constituted by bearings, the pressing members are made of pressing plates having the shape of a flat plate, the shafts of the support rollers are supported at both ends thereof by bearing holders via the bearings, each of the bearings holders has a main plate member in which are formed in parallel a cylindrical support portion that fits to and supports the bearing of one support roller and an elongated support hole that fits to and supports the bearing of the other support roller in a manner to move in a direction in which it approaches, or separates away from, the one support roller, the main plate member having nearly a constant thickness, the cylindrical support portion extends from one surface of the main plate member, a space for removably inserting the corresponding pressing plate is formed in the main plate member of the bearing holder between the cylindrical support portion and the elongated support hole, the space opening in one side surface which extends in a direction in which the cylindrical support portion and the elongated support hole are arranged in parallel, the opening in the one side surface extends linearly along the one side surface maintaining a predetermined width, and wherein when the pressing plate is inserted through the opening in the one side surface of each bearing holder, the pair of tilted pressing surfaces of the pressing plate are brought into contact with the outer circumferential surfaces of the bearings supported by the cylindrical support portion and by the elongated support hole.

It is desired that each pressing plate has a symmetrical shape in the direction of width relative to the center line extending in the longitudinal direction as viewed on a plane, has a pair of tilted pressing surfaces formed on both sides thereof in the direction of width and linearly tilted in one longitudinal direction toward the center line, has a rectangular tongue piece extending in one longitudinal direction from the central region between the ends of the tilted pressing surfaces, has a pair of stepped portions extending in the direction of width between the ends of the tilted pressing surfaces and the proximal ends on both sides of the tongue piece in the direction of width, and has a pair of other tilted end surfaces linearly tilted from the other ends of the tilted pressing surfaces toward the center line in the other longitudinal direction, wherein an angle at which the pair of other tilted end surfaces are meeting together at the center in the direction of width is formed by curved surfaces and defines the other protruded end portion of the pressing plate and, when the pressing plate is inserted through the opening in the one side surface of each bearing holder, the other protruded end portion of the pressing plate is positioned protruding beyond the opening in the side surface of the bearing holder.

It is desired that each side plate has a notch linearly extending outward in the radial direction of the fixing roller maintaining a constant width from part of the region of the outer circumferential surface of the support hole supporting the bearing of the fixing roller, and each bearing holder is arranged on the inside of the corresponding side plate and is supported by the corresponding side plate in a manner that the outer circumferential surface of the cylindrical support portion is fitted to the notch so as to slide and rotate therein.

It is desired that coupling members are arranged between the side plates at positions on the outer side of the fixing roller in the radial direction and at positions on the outer side of the bearing holders in the radial direction, pressing means are arranged at positions on the insides of the side plates and on the outer side of the bearing holders in the radial direction, the pressing means comprising pressing arm members having ends on one side thereof engaged with, and supported by, the engaging portions of the coupling members so as to rotate, spring members engaged at the ends on one side thereof with the other ends of the pressing arm members, and pressing lever members supported on the insides of the side plates via a shaft so as to rotate and being engaged at the ends on one side thereof with the other ends of the spring members, wherein when a rotational moment is acted on the other ends of the pressing lever members to rotate the pressing lever members in one direction about the shaft against the spring forces of the sprig members, the pressing arm members are rotated due to the spring forces of the spring members with the engaging portions of the coupling members as a fulcrum, and the other protruded end portions of the corresponding pressing plates are pressed, so that the pressing plates are pressed toward the axis of the fixing roller.

DESCRIPTION OF THE PREFERRED EMBODIMENTS

Figure 1:
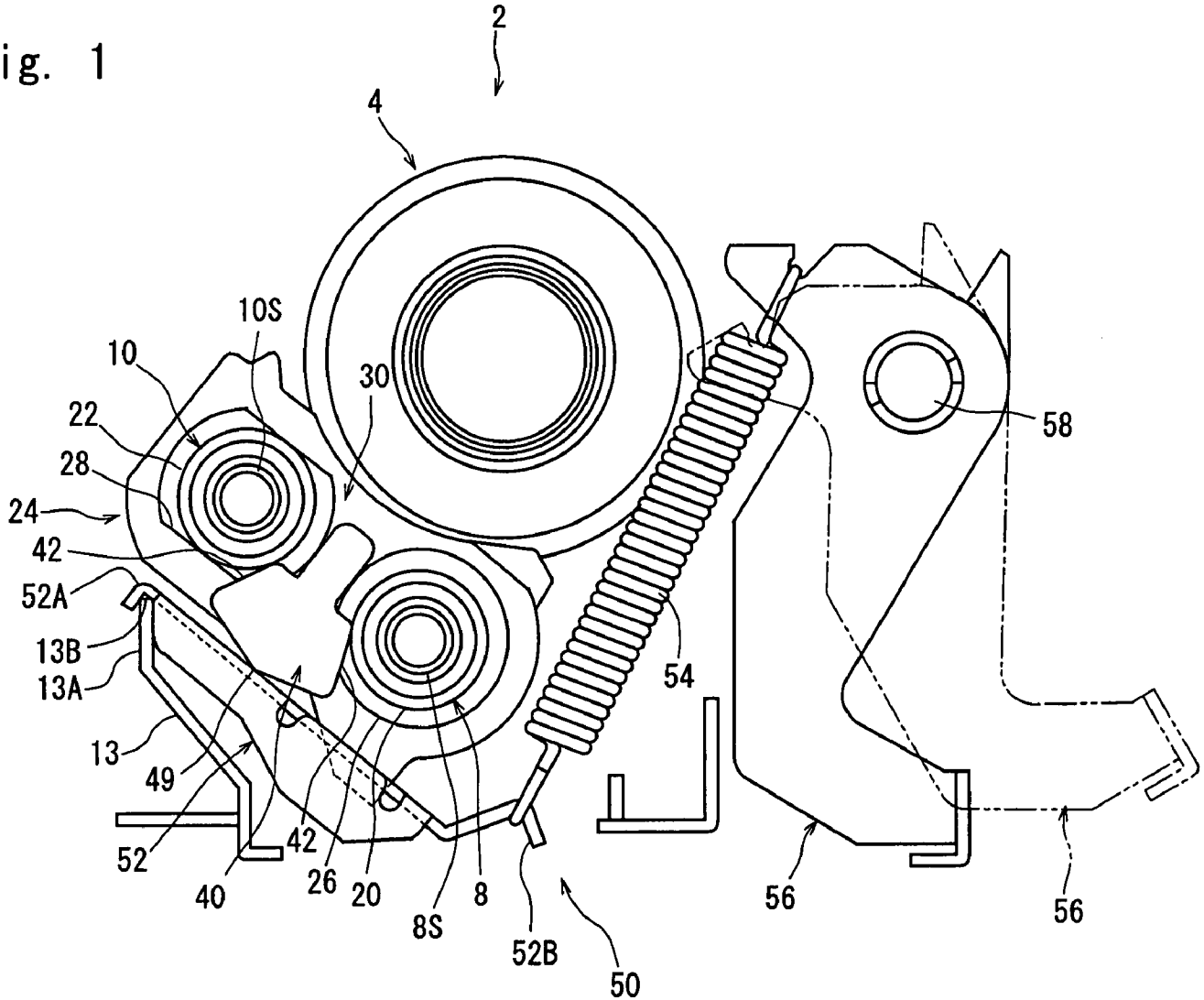
FIG. 1 is a view schematically illustrating the constitution of a major portion of a fixing device according to an embodiment of the present invention as viewing from the axial direction of the rollers.

Preferred embodiments of the fixing device constituted according to the present invention will now be described in detail with reference to the accompanying drawings. In FIGS. 1 to 8, portions which are substantially the same are denoted by the same reference numerals.

Figure 2:
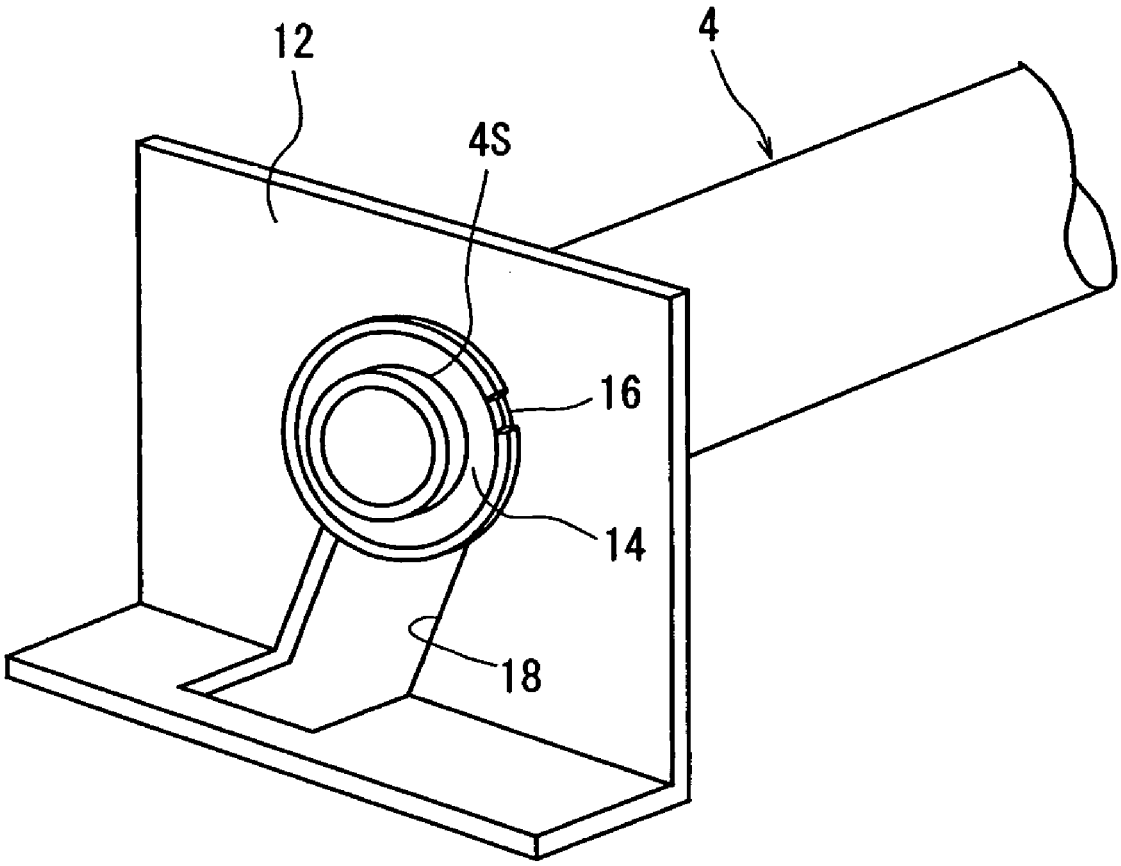
FIG. 2 is a perspective view schematically illustrating a portion of the fixing device shown in FIG. 1.
Figure 3:
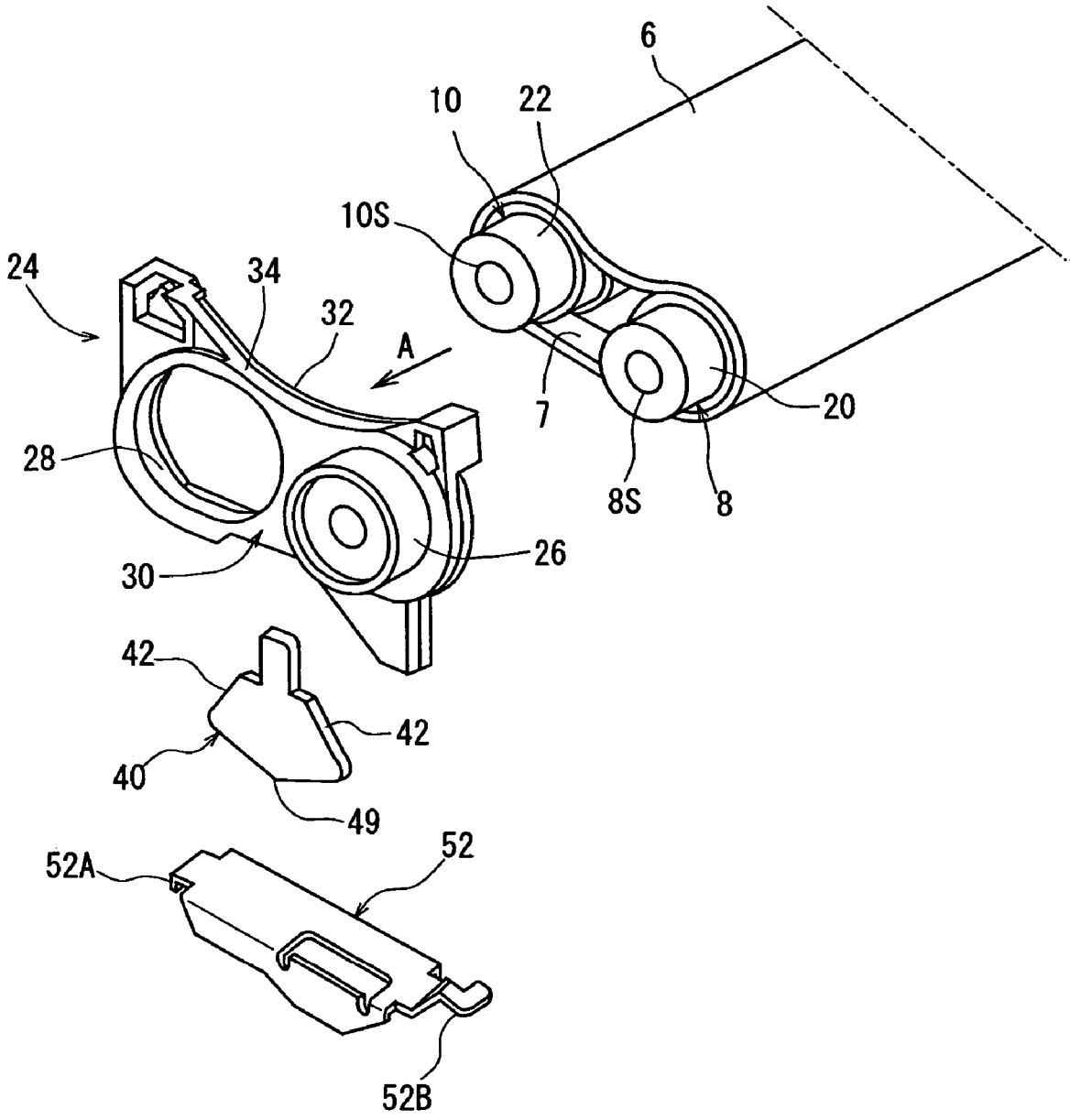
FIG. 3 is a perspective view of the fixing device shown in FIG. 1 by disassembling part of the constituent members thereof.
Figure 4:
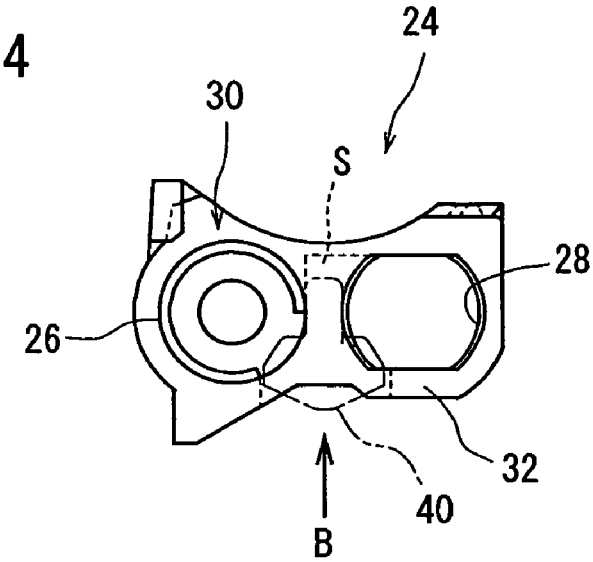
FIG. 4 is a view of a bearing holder shown in FIG. 3 as viewing in the direction of an arrow A in FIG. 3.
Figure 5:
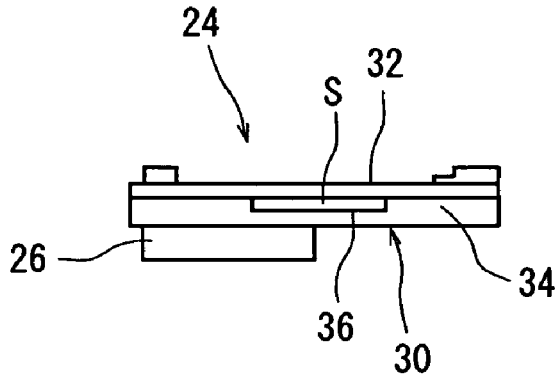
FIG. 5 is a view of the bearing holder shown in FIG. 4 as viewing in the direction of an arrow B in FIG. 4.

Referring to FIGS. 1 to 3, a fixing device 2 includes a fixing roller (heat roller) 4, and two support rollers 8 and 10 arranged maintaining a distance in a tangential direction of the fixing roller 4 and wrapped with a belt 6. The support rollers 8 and 10 are press-contacted to the fixing roller 4 via the belt 6. A halogen heater (not shown) which is a source of heat is arranged at the center of the fixing roller 4. Ribs 7 (see FIG. 7) for preventing meandering are arranged by the inner circumferential surfaces on both sides of the belt 6 in the direction of width extending over the whole circumference. In the illustrated embodiment, the ribs 7 have a rectangular shape in transverse cross section. Annular steps are formed on the support rollers 8 and 10 at both ends thereof due to a difference in the outer diameters, and are so arranged as to be positioned on the insides of the corresponding ribs 7 in the direction of width.

The fixing device 2 is provided with a pair of side plates (only one side plate 12 is shown in FIG. 2) arranged being opposed to each other maintaining a distance. The shaft 4S of the fixing roller 4 is supported at both ends by the pair of side plates 12 via bearings 14 so as to rotate. Each side plate 12 has a notch 18 extending straight outward in the radial direction relative to the fixing roller 4 maintaining a predetermined width from part of the region of the outer circumferential surface of a support hole 16 which supports the bearing 14 of the fixing roller 4.

At both ends of the shafts 8S and 10S of the support rollers 8 and 10, there are arranged support members having circular outer circumferential surfaces or, in this embodiment, bearings 20 and 22. Both ends of the shafts 8S and 10S of the support rollers 8 and 10 are supported by bearing holders 24 via the bearings 20 and 22. Referring to FIGS. 1 and 3 to 5, the bearings holders 24 constituted in substantially the same manner have main plate members 30 in which are formed in parallel a cylindrical support portion 26 that fits to and supports the bearing 20 of one support roller 8 and an elongated support hole 28 that fits to and supports the bearing 22 of the other support roller 10 in a manner to move in a direction in which it approaches, or separates away from, the one support roller 8. The main plate member 30 is constituted by removably overlapping a plate member 32 and a resin member 34 one upon the other, and has nearly a constant thickness. The cylindrical support portion 26 extends from one surface of the main plate member 30 by a predetermined length.

Figure 6:
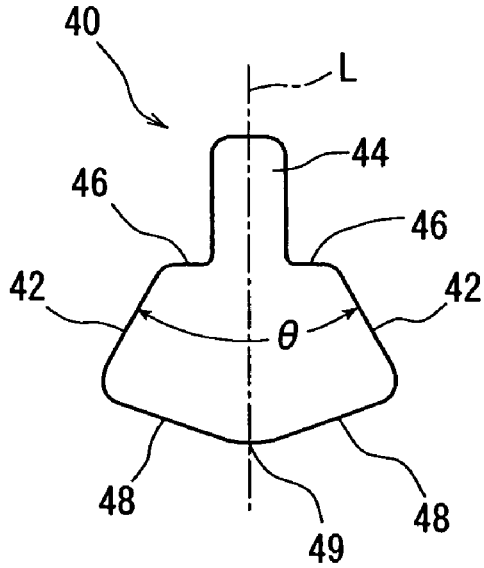
FIG. 6 is a front view of a pressing member shown in FIG. 3.

Pressing plates 40 which are the pressing members having substantially the same constitution are arranged between the bearings 20 and the bearings 22 at both ends of the shafts 8S and 10S of the support rollers 8 and 10. Referring to FIG. 6, each of the pressing plates 40 of the shape of a flat plate has a pair of tilted pressing surfaces 42 that come in contact with the outer circumferential surfaces of the bearings 20 and 22. If described more concretely, spaces S for removably inserting the pressing plates 40 are formed in the main plate members 30 of the bearing holders 24 between the cylindrical support portion 26 and the elongated support hole 28, the spaces S opening in one side surfaces which extend in a direction in which the cylindrical support portion 26 and the elongated support hole 28 are arranged in parallel. The opening 36 in the one side surface extends linearly along the one side surface maintaining a predetermined width. The space S and the opening 36 of the main plate member 30 in each bearing holder 24 are formed between the plate member 32 and the resin member 34. The space S extends in the form of a flat plate maintaining a predetermined distance which is the same as the width of the opening 36.

Referring to FIG. 6, each pressing plate 40 has a symmetrical shape in the direction of width (right-and-left direction in FIG. 6) relative to the center line L extending in the longitudinal direction (up-and-down direction in FIG. 6) as viewed on a plane, and has a pair of tilted pressing surfaces 42, a rectangular tongue piece 44, and a pair of other tilted end surfaces 48. The pair of tilted pressing surfaces 42 are formed on both sides in the direction of width and are tilted straight in one longitudinal direction (upward in FIG. 6) toward the center line L. The tongue piece 44 extends in one longitudinal direction from the central regions at the ends of the tilted pressing surfaces 42. A pair of stepped portions 46 extend in the direction of width between the ends of the tilted pressing surfaces 42 and the proximal ends on both sides of the tongue piece 44 in the direction of width. The pair of other tilted end surfaces 48 are linearly tilted from the other ends of the tilted pressing surfaces 42 toward the center line L in the other longitudinal direction (downward in FIG. 6). An angle at which the pair of other tilted end surfaces 48 are meeting together at the center in the direction of width is formed by curved surfaces and defines the other protruded end portion 49 of the pressing plate 40.

When the pressing plates 40 are inserted in the spaces S from the openings 36 in the one side surfaces of the bearing holders 24, the pairs of tilted pressing surfaces 42 of the pressing plates 40 are brought into contact with the outer peripheral surfaces of the bearings 20 and 22 supported by the cylindrical support portions 26 and by the elongated support holes 28. Further, the other protruded end portions 49 of the pressing plates 40 are positioned protruding beyond the openings 36 in the one side surfaces of the bearing holders 24 (see FIGS. 4 and 5).

Referring to FIGS. 1 to 3, the bearing holders 24 are arranged on the insides of the corresponding side plates 12 and are supported by the corresponding side plates 12 on the insides thereof in a manner that the outer circumferential surfaces of the cylindrical support portions 26 are fitted to the notches 18 so as to slide and rotate therein. Therefore, the bearing holders 24 and the bearings 20 of the support roller 8 fitted to, and supported by, the cylindrical support portions 26, are substantially limited from moving in the tangential direction of the fixing roller 4.

The fixing device 2 includes pressing means 50 arranged for the pressing plates 40 and releasably presses the pressing plates 40 toward the axis of the fixing roller 4. When pressed by the corresponding pressing means 50, the pressing plates 40 press the support rollers 8 and 10 toward the axis of the fixing roller 4 via the pair of tilted pressing surfaces 42 and via the outer circumferential surfaces of the bearings 20 and 22 so that part of the region of the belt 6 in the circumferential direction is press-contacted to part of the region on the outer circumferential surface of the fixing roller 4 and, further, press the support rollers 8 and 10 in a direction in which they separate away from each other to impart a tension to the belt 6.

If described more concretely, coupling plates 13 which are the coupling members are arranged between the side plates 12 at positions on the outer side of the fixing roller 4 in the radial direction and at positions on the outer side of the bearing holders 24 in the radial direction (positions on the outer side of the fixing roller 4 in the radial direction) . Each coupling plate 13 has an upper end portion 13A vertically extending as shown in FIG. 1, and has an engaging portion 13B formed at the upper end of the upper end portion 13A on the inside of the side plate 12. The engaging portion 13B is formed of a groove of the shape of a channel. The pressing means 50 includes a pair of pressing arm members 52, a pair of tension coil springs 54 which are a pair of spring members, and a pair of pressing lever members 56.

The pair of pressing arm members 52 having substantially the same constitution are arranged at positions on the outer side of the bearing holders 24 in the radial direction on the insides of the side plates 12, and have the ends 52A on one side thereof that are engaged with, and supported by, the engaging portions 13B of the coupling plates 13 so as to rotate. The pressing arm members 52 are constituted by slender sheet metals of the shape of a channel in transverse cross section and are folded in an L-shape at the ends 52A on one side thereof and at the ends 52B on the other side thereof. The pair of tension coil springs 54 have substantially the same constitution, and are engaged at the ends on one side thereof with the ends 52B on the other side of the pressing arm members 52. The pair of pressing lever members 56 having substantially the same constitution are supported at the intermediate portions thereof by the inner sides of the side plates 12 via the shaft 58 so as to rotate, and are engaged at the ends thereof having the shape of a hook with the other ends of the tension coil springs 54.

Figure 7:
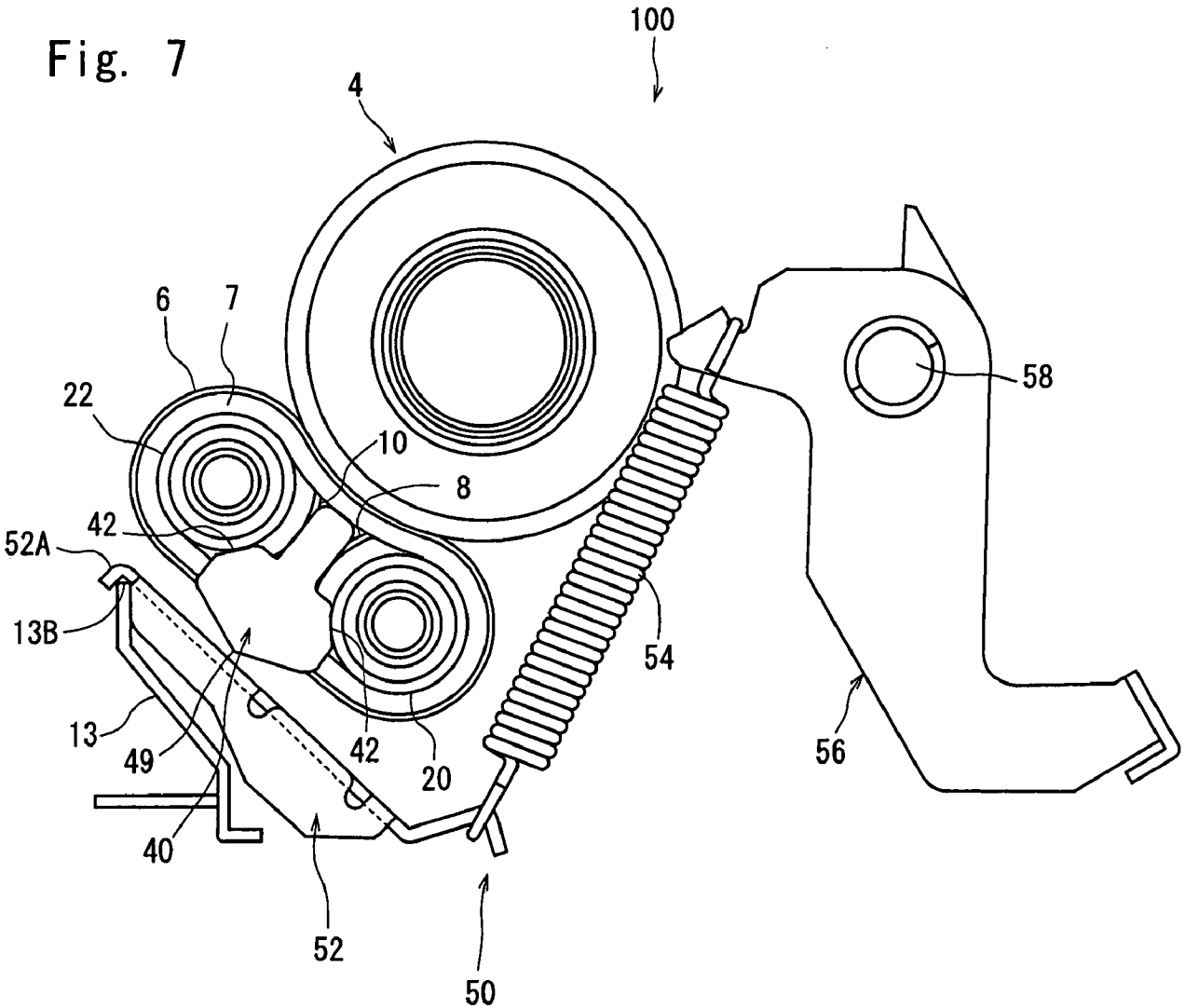
FIG. 7 is a view schematically illustrating the constitution of a major portion of the fixing device according to another embodiment of the present invention as viewing from the axial direction of the rollers.

Referring to FIG. 7, in a state where no external force is acting on the pressing lever members 56, the hook-shaped ends of the pressing lever members 56 are positioned so as to extend nearly horizontally (see FIG. 7). The pressing arm members 52 are so positioned as to extend as a whole in nearly the tangential direction of the fixing roller 4 in a state where the ends 52A on one side thereof are engaged with, and supported by, the engaging portions 13B. The ends 52B on the other side of the pressing arm members 52 are positioned to be lower than the ends 52A on one side thereof. The force for moving the bearing holders 24 downward or, more concretely, the force for moving the unit comprising the support rollers 8, 10, belt 6, bearings 20, 22, bearing holders 24 and pressing plates 40, downward, is transmitted to the pressing lever members 56 via the pressing plates 40, pressing arm members 52 and tension coil springs 54 so as to rotate the pressing lever members 56 about the shaft 58 in the counterclockwise direction in FIGS. 1 and 7, which, however, is limited by stoppers (not shown) provided on the side plates 12. Therefore, the pressing force of the pressing means 50 does not act on the above unit.

The rotational moment is acted on the other ends of the pressing lever members 56 to rotate the pressing lever members 56 in one direction (clockwise direction in FIGS. 1 and 7) about the shaft 58 against the spring forces of the tension coil springs 54. Then, the pressing arm members 52 are rotated counterclockwise in FIGS. 1 and 7 due to the spring forces of the tension coil springs 54 with the engaging portions 13B of the coupling plates 13 as a fulcrum, whereby other protruded end portions 49 of the corresponding pressing plates 40 are pressed, so that the pressing plates 40 are pressed toward the axis of the fixing roller 4. The pressing plates 40 press the support rollers 8 and 10 toward the axis of the fixing roller 4 via the pair of tilted pressing surfaces 42 and the outer circumferential surfaces of the bearings 20, 22, to bring part of the region of the belt 6 in the circumerential direction into pressed contact with part of the region on the outer curcumferential surface of the fixing roller 4, and to press the support rollers 8 and 10 in a direction to separate away from each other to impart a tension to the belt 6 (see FIG. 8). When the pairs of tilted pressing surfaces 42 of the pressing plates 40 press the outer circumferential surfaces of the bearings 20, 22 of the support rollers 8 and 10 so that they are separated away from each other in the tangential direction of the fixing roller 4, limitation is substantially imposed on the motion of the bearing holders 24 and of the bearings 20 of the support roller 8 fitted to, and supported by, the cylindrical support portions 26 in the tangential direction of the fixing roller 4. Therefore, the bearings 22 of the support roller 10 only move in the tangential direction to separate away from the bearings 20 of the support roller 8 along the elongated support holes 28, thereby to impart a tension to the belt 6.

The fixing device 2 of the present invention makes it possible to easily set a distribution (ratio) of the tension of the belt 6 and the force of bringing the two support rollers 8 and 10 into pressed contact with the fixing roller 4 via the belt 6 relying on a simple constitution. That is, an increase in the tilting angle θ (see FIG. 6) of the pairs of tilted pressing surfaces 42 of the pressing plates 40 causes a decrease in the tension of the belt 6 while causing an increase in the force of bringing the support members 8 and 10 into pressed contact with the fixing roller 4 via the belt 6. On the other hand, a decrease in the tilting angle θ causes an increase in the tension of the belt 6 while causing a decrease in the force of bringing the support members 8 and 10 into pressed contact with the fixing roller 4 via the belt 6. According to the fixing device 2 of the present invention, as described above, it is made possible to easily set a balance as desired between the tension of the belt 6 and the force of bringing the support rollers 8 and 10 into pressed contact with the fixing roller 4 via the belt 6 by setting, as desired, the tilting angle θ of the pairs of tilted pressing surfaces 42 of the pressing plates 40.

Figure 8:
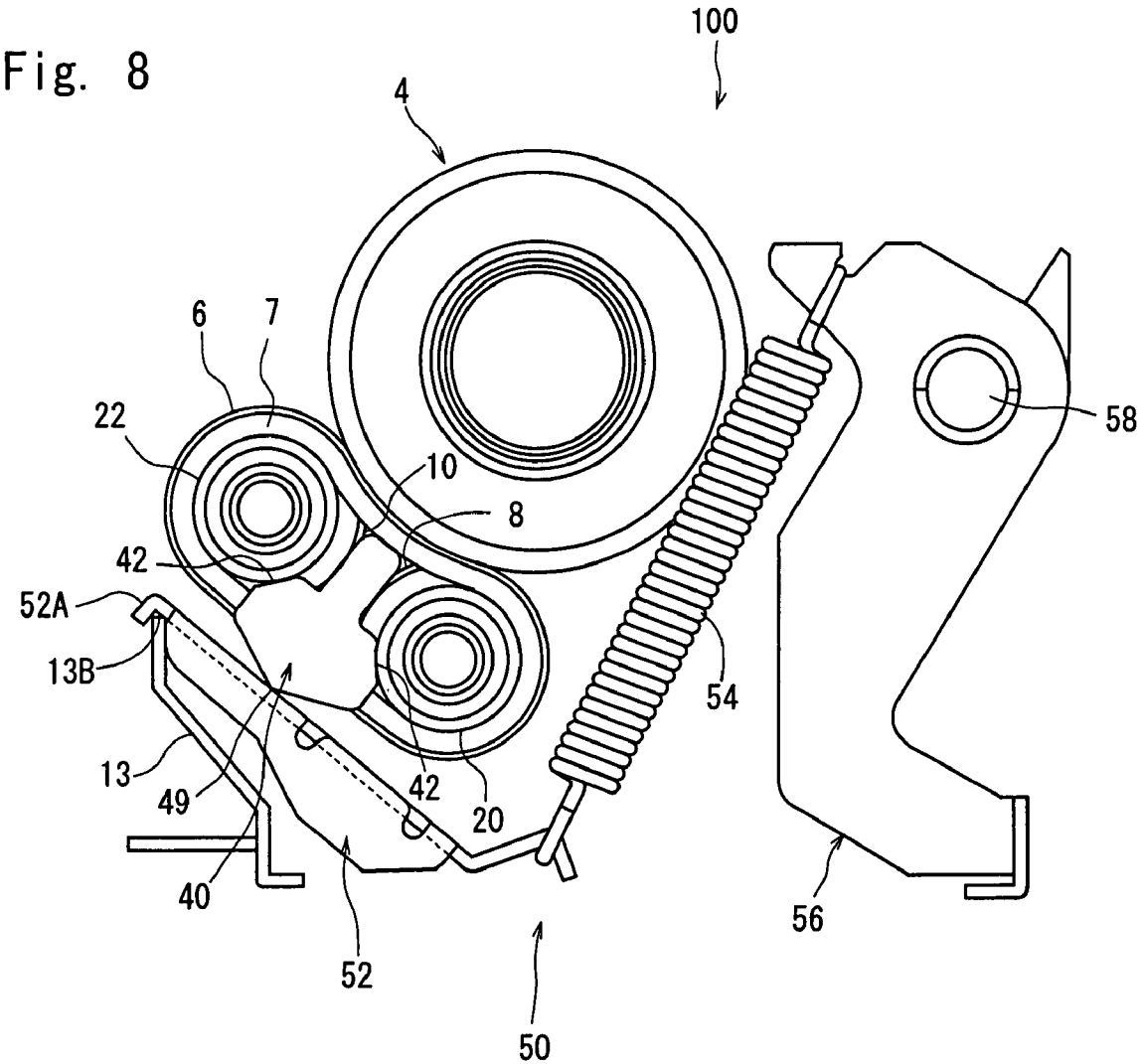
FIG. 8 is a schematic view of the constitution for illustrating another mode of operation of the fixing device shown in FIG. 7.

FIGS. 7 and 8 illustrate a fixing device 100 according to another embodiment of the present invention. What makes the fixing device 100 of the invention shown in FIGS. 7 and 8 different from the fixing device 2 described with reference to FIGS. 1 to 6 is that the tilting angle θ of the pairs of tilted pressing surfaces 42 of the pressing plates 40 is greater than that of the fixing device 2. The constitution, however, is substantially the same in other respects. For instance, the tilting angle θ of the pairs of tilted pressing surfaces 42 of the pressing plates 40 is 50 degrees in the fixing device 2 while the tilting angle θ of the pairs of tilted pressing surfaces 42 of the pressing plates 40 is 90 degrees in the fixing device 100. The fixing device 100 shown in FIG. 7 is in a state where the pressing plates 40 have not been pressed by the pressing means 50 while the fixing device 100 shown in FIG. 8 is in a state where the pressing plates 40 have been pressed by the pressing means 50.

In the fixing devices 2 and 100 of the present invention, the operation for rotating the pressing lever members 56 in one direction (clockwise direction in FIGS. 1 and 7) about the shaft 58 against the spring forces of the tension coil springs 54 by acting a rotational moment on the other ends of the pressing lever members 56, can be executed being linked to the operation of removably mounting the unit on the image-forming machine that is not shown, for example, being linked to the operation of mounting the paper conveyer unit on the image-forming machine. Referring to FIGS. 7 and 8, when the conveyer unit is drawn from the image-forming machine to cope with the jamming, the pressing lever members 56 are rotated about the shaft 58 counterclockwise in FIG. 8 due to the spring forces of the tension coil springs 54, and the pressing plates 40 are no longer pressed (see FIG. 7). On the other hand, when the conveyer unit that has been drawn from the image-forming unit is mounted again on the image-forming machine, the rotational moment is acted on the other end of the pressing lever members 56 which are, then, rotated in one direction (clockwise direction in Fi. 7) about the shaft 58 against the spring forces of the tension coil springs 54; i.e., the pressing plates 40 are pressed (see FIG. 8).

The fixing roller 4 is drive-coupled to, for example, an electric motor which is a source of drive through a drive transmission mechanism such as gears (none of them are shown). When the unit of support rollers 8, 10 and belt 6 is urged toward the fixing roller in a state where a tension is imparted to the belt 6 as described above, the support rollers 8 and 10 are press-contacted to the fixing roller 4 via the belt 6 and, besides, the region between the support rollers 8 and 10 on the outer circumferential surface of the belt 6 is press-contacted to the fixing roller 4. When the fixing roller 4 is driven by the electric motor to rotate clockwise in FIGS. 1 and 8, the support rollers 8 and 10 are driven together with the belt 6 to rotate counterclockwise. When an electric current is supplied to a halogen heater in the fixing roller 4 to generate the heat, the temperature of the fixing roller 4 starts rising. The heat transmitted to the fixing roller 4 is further transmitted to the belt 6 and to the support rollers 8 and 10 via the belt 6. After the surface of the fixing roller 4 is heated to a predetermined temperature from normal temperature, a paper (not shown) on which the one surface (upper surface) the toner has been transferred is conveyed nearly from the right toward the left in FIGS. 1 and 8, and passes through the fixing roller 4, the belt 6 and the portions nipped by the support rollers 8 and 10, whereby the unfixed toner transferred onto the one surface of the paper is melt-fixed to the one surface of the paper by the fixing roller 4.

What we claim is:

1. A fixing device comprising a fixing roller, and two support rollers arranged maintaining a distance in a tangential direction of the fixing roller and wrapped with an endless belt, the support rollers being press-contacted to the fixing roller via said belt, said fixing device further comprising:

support members arranged at both ends of the shafts of the support rollers and having circular outer circumferential surfaces;

pressing members arranged between the support members at both ends thereof and each having a pair of tilted pressing surfaces that come in contact with said outer circumferential surfaces; and pressing means arranged for the pressing members and releasably presses the pressing members toward the axis of the fixing roller;

wherein when pressed by the corresponding pressing means, the pressing members press the support rollers toward the axis of the fixing roller via the pairs of tilted pressing surfaces and via the outer circumferential surfaces of the support members so that part of the region of said belt in the circumferential direction is press-contacted to part of the region on the outer circumferential surface of the fixing roller and, further, press the support rollers in a direction in which they separate away from each other to impart a tension to said belt.

2. A fixing device according to claim 1, wherein both ends of the shaft of the fixing roller are supported by a pair of side plates via bearings so as to rotate, the support members are constituted by bearings, the pressing members are made of pressing plates having the shape of a flat plate, the shafts of the support rollers are supported at both ends thereof by bearing holders via said bearings, each of the bearings holders has a main plate member in which are formed in parallel a cylindrical support portion that fits to and supports the bearing of one support roller and an elongated support hole that fits to and supports the bearing of the other support roller in a manner to move in a direction in which it approaches, or separates away from, the one support roller, said main plate member having nearly a constant thickness, the cylindrical support portion extends from one surface of the main plate member, a space for removably inserting the corresponding pressing plate is formed in the main plate member of the bearing holder between the cylindrical support portion and the elongated support hole, the space opening in one side surface which extends in a direction in which the cylindrical support portion and the elongated support hole are arranged in parallel, the opening in said one side surface extends linearly along said one side surface maintaining a predetermined width, and wherein when the pressing plate is inserted through said opening in said one side surface of each bearing holder, the pair of tilted pressing surfaces of the pressing plate are brought into contact with the outer circumferential surfaces of the bearings supported by the cylindrical support portion and by the elongated support hole.

3. A fixing device according to claim 2, wherein each pressing plate has a symmetrical shape in the direction of width relative to the center line extending in the longitudinal direction as viewed on a plane, has a pair of tilted pressing surfaces formed on both sides thereof in the direction of width and linearly tilted in one longitudinal direction toward said center line, has a rectangular tongue piece extending in one longitudinal direction from the central region between the ends of said tilted pressing surfaces, has a pair of stepped portions extending in the direction of width between said ends of said tilted pressing surfaces and the proximal ends on both sides of the tongue piece in the direction of width, and has a pair of other tilted end surfaces linearly tilted from the other ends of said tilted pressing surfaces toward said center line in the other longitudinal direction, wherein an angle at which said pair of other tilted end surfaces are meeting together at the center in the direction of width is formed by curved surfaces and defines the other protruded end portion of the pressing plate and, when the pressing plate is inserted through said opening in said one side surface of each bearing holder, a protruded end portion of the pressing plate is positioned protruding beyond said opening in said side surface of the bearing holder.

4. A fixing device according to claim 3, wherein each side plate has a notch linearly extending outward in the radial direction of the fixing roller maintaining a constant width from part of the region of the outer circumferential surface of the support hole supporting the bearing of the fixing roller, and each bearing holder is arranged on the inside of the corresponding side plate and is supported by the corresponding side plate in a manner that the outer circumferential surface of the cylindrical support portion is fitted to the notch so as to slide and rotate therein.

5. A fixing device according to claim 4, wherein coupling members having engaging portions are arranged between the side plates at positions on the outer side of the fixing roller in the radial direction and at positions on the outer side of the bearing holders in the radial direction, pressing means are arranged at positions on the insides of the side plates and on the outer side of the bearing holders in said radial direction, the pressing means comprising pressing arm members having first ends on one side thereof engaged with, and supported by, the engaging portions of the coupling members so as to rotate, spring members having first ends engaged at second ends of the pressing arm members, and pressing lever members, supported on the insides of the side plates via a shaft so as to rotate, and having first ends engaged with second ends of the spring members, wherein when a rotational moment is acted on second ends of the pressing lever members to rotate the pressing lever members in one direction about the shaft against the spring forces of the spring members, the pressing arm members are rotated due to the spring forces of the spring members with the engaging portions of the coupling members as a fulcrum, and said protruded end portions of the corresponding pressing plates are pressed, so that the pressing plates are pressed toward the axis of the fixing roller.

* * * * *